US005150792A

United States Patent [19]

Munroe

[11] Patent Number: 5,150,792

[45] Date of Patent: Sep. 29, 1992

[54] DISPLAY DEVICE FOR COIN CERTIFICATION ENCASEMENTS

[76] Inventor: David M. Munroe, 18815 Moore, Allen Park, Mich. 48101

[21] Appl. No.: 695,947

[22] Filed: May 6, 1991

[51] Int. Cl.[5] ..... B65D 85/58; A45C 11/28

[52] U.S. Cl. ..... 206/486; 206/0.84; 206/472

[58] Field of Search ..... 206/0.83, 0.84, 472, 206/475, 456, 455, 0.82, 486, 488–490

[56] References Cited

U.S. PATENT DOCUMENTS

| | | | |
|---|---|---|---|
| 789,076 | 5/1905 | Trahan et al. | 206/486 X |
| 2,139,150 | 12/1938 | Curtis | 206/489 X |
| 2,258,535 | 10/1941 | Buranelli | 206/0.84 |
| 2,521,792 | 9/1950 | Hollender | 206/0.83 |
| 3,028,949 | 4/1962 | Sohosky | 206/0.83 |
| 3,064,805 | 11/1962 | Bains | 206/0.83 |
| 3,178,014 | 4/1965 | Goldwasser | 206/0.83 |
| 3,217,866 | 11/1965 | Phelps | 206/0.83 |
| 3,285,397 | 11/1966 | Silverman | 206/0.83 |
| 3,322,269 | 5/1967 | Neyer | 206/488 |
| 3,788,464 | 1/1974 | Skinner | 206/0.82 |
| 3,913,732 | 10/1975 | Peterson . | |
| 4,043,477 | 8/1977 | Deese . | |
| 4,063,639 | 12/1977 | Grant | 206/0.82 |
| 4,385,688 | 5/1983 | Grant . | |
| 4,402,399 | 9/1983 | Friess . | |
| 4,681,221 | 7/1987 | Chickanosky et al. | 206/486 X |
| 4,915,214 | 4/1990 | Wieder | 206/0.82 |
| 4,928,828 | 5/1990 | Cohen | 206/472 X |

FOREIGN PATENT DOCUMENTS

| | | | |
|---|---|---|---|
| 1264641 | 5/1961 | France | 206/486 |

OTHER PUBLICATIONS

Information Sheets (2) of Eagle Products of Lyons, Ill.–Date unknown.

*Primary Examiner*—Bryon P. Gehman
*Attorney, Agent, or Firm*—Peter D. Keefe

[57] ABSTRACT

A display device in the form of a mounting frame which releasably holds a plurality of coin certification encasements (slabs) in a predetermined pattern. The mounting frame has a plurality of slab seats, each in the form of an aperture dimensioned to receive a slab, a peripheral lip running along the sidewalls of the aperture for retaining the slab in a seated position within the aperture, and at the other end of each aperture a resilient boss on opposing sidewalls. In operation, a slab is placed forceably between the two resilient lips and seated within the aperture, both sides of the coin and its slab being visible. When it is desired to remove the slab from the display device, the user simply forces the slab past the resilient bosses. Alternatively, the apertures may be provided with resiliently biased curved sidewalls which frictionally engage the edges of the slab so as to seat the slab within the aperture.

8 Claims, 2 Drawing Sheets

DISPLAY DEVICE FOR COIN CERTIFICATION ENCASEMENTS

BACKGROUND OF THE INVENTION

1. Field of the Invention

The present invention relates to display devices for holding articles in a predetermined pattern, and more particularly to a display device for retaining coin holders, the display device being in the form of an album page. Still more particularly, the present invention relates to a display device for arranging and releasably retaining articles in the form of coin certification encasements, popularly known as "slabs".

2. Description of the Prior Art

Over the years, grading and certification of coins has become a standardized procedure. According to this procedure, coin collectors send their coins to dealers, who in turn prepare the necessary paperwork and then send the coin to a certification service where the coin is graded and certified. The certification service assigns a number to the coin, grades the coin through independent graders, and then places the coin and a ticket bearing its registration number and grade into a coin certification encasement, popularly called a "slab". The slab is a clear plastic holder of rectangular shape that has been sonically welded into a tamper-proof encasement for the coin. The plastic is clear and provides easy view of the coin and its registration number, while preventing environmental damage to the coin, as well as preventing tampering. Examples of certification services which provide slabs are: Professional Coin Grading Service (PCGS) of Newport Beach, Calif.; Numismatic Guaranty Corporation of America (NGC) of Parsippany, NJ; American Numistic Association Grading Service (ANACS) of Columbus, Ohio; Numistic Certification Institute (NCI) of Dallas, Tex.; Compugrade of Metairie, La.; Accugrade of Stamford, Conn.; International Numistic Grading Services of Philadelphia, Pa.; and Photo-Certified Coin Institute (PCI) of Chattanooga, Tenn. The present invention pertains to a display device for the slabs made by these and other certification services.

For purposes of displaying coins, it is very convenient to provide a display device in the form of a "page" which arranges the coins in a predetermined pattern across the page. The pages assemble into an album, which may then be utilized for presentation purposes with other collectors.

In the prior art, there are several types of display devices for coins.

U.S. Pat. No. 3,913,732 to Peterson, dated Oct. 21, 1975, discloses a display page for coins in which coins are arranged in a symmetric pattern on the page. The page is constructed of three plastic sheets, with recesses into which the coins are inserted. A band connected with an uppermost sheet holds the coins in place. The bottom sheet is clear, so the coins can be seen on both sides. This device suffers from the disadvantage that coins must be placed directly into the recesses; coins do not have their own holder which would serve to protect them from the environment and tampering.

U.S. Pat. No. 4,402,399 to Fries, dated Sept. 6, 1983, discloses a display device composed of two rigid clear plastic sheets that overlay a number of coin recesses that are arranged in a predetermined pattern. The two plastic sheets are held together by screws. This device suffers from the disadvantage of extremely difficult accessibility to the coins when the collector wishes to modify the collection. Also, the coins are not protected in certified coin encasements (slabs).

U.S. Pat. No. 4,043,477 to Deese, dated Aug. 23, 1977, discloses a coin holder which is specially constructed for being connected with other coin holders by interlock members. A page of coin holders can thereby be constructed for purposes of use in an album. This device suffers from the need to use specially constructed coin holders which are not certified coin encasements (slabs).

U.S. Pat. No. 4,385,688 to Grant, dated May 31, 1983, discloses a display device in the shape of an album page, having a plurality of apertures. Each aperture is structured to receive a coin holder. The walls of each aperture and the coin holder are specially shaped so as to cooperate together to retain the coin holder with respect to the aperture. The cooperation is disclosed as being in the form of a groove to rib interconnection, tapered extension to tapered slot interconnection, or flange interconnection.

While the patent to Grant is closest to solving the problem of providing a display device for slabs, it suffers from the requirement that there be a particular structural cooperation between the display device and the coin holder. This requirement necessitates that only specially structured coin holders can be used with the Grant display device, not certified coin encasements (slabs).

Accordingly, what remains needed is a display device for arranging and releasably retaining slabs.

SUMMARY OF THE INVENTION

The present invention is a display device in the form of a mounting frame which releasably holds a plurality of slabs in a predetermined pattern.

The display device according to the present invention is a substantially rectangularly shaped mounting frame having a plurality of seats for retaining certified coin encasements, known popularly, and referred to hereinafter, as slabs. The seats are each characterized by an aperture disposed in the mounting frame, and are collectively arranged in a regular pattern on the mounting frame. Each of the apertures is dimensioned to receive a slab. In this regard, it is preferred for one end of each aperture to have a peripheral lip located at the sidewalls of the aperture for retaining the slab in a seated position within the aperture. It is further preferred that at the other end of each aperture a resilient boss be provided on two mutually opposing sidewalls. In operation, a slab is placed forceably between the two resilient bosses and seated within the aperture, both sides of the coin and its coin holder being visible. When it is desired to remove the slab, the user simply forces the slab past the resilient bosses.

Alternatively, the apertures may be provided with resiliently biased curved sidewalls which frictionally engage the edges of the slab to retain the slab within the aperture.

Accordingly, it is an object of the present invention to provide a display device for slabs in which a plurality of apertures are provided for releasably arranging and retaining slabs.

It is another object of the present invention to provide a display device for slabs in which a plurality of apertures are provided for releasably retaining the slabs by operation of resilient bosses located at one end of the aperture.

Accordingly, it is an object of the present invention to provide a display device for slabs in which a plurality of apertures are provided for releasably retaining slabs by frictional interaction of the edges of the slab with the sidewalls of the aperture.

These, and additional objects, advantages, features and benefits of the present invention will become apparent from the following specification.

DETAILED DESCRIPTION OF THE PREFERRED EMBODIMENTS

Figure 1:
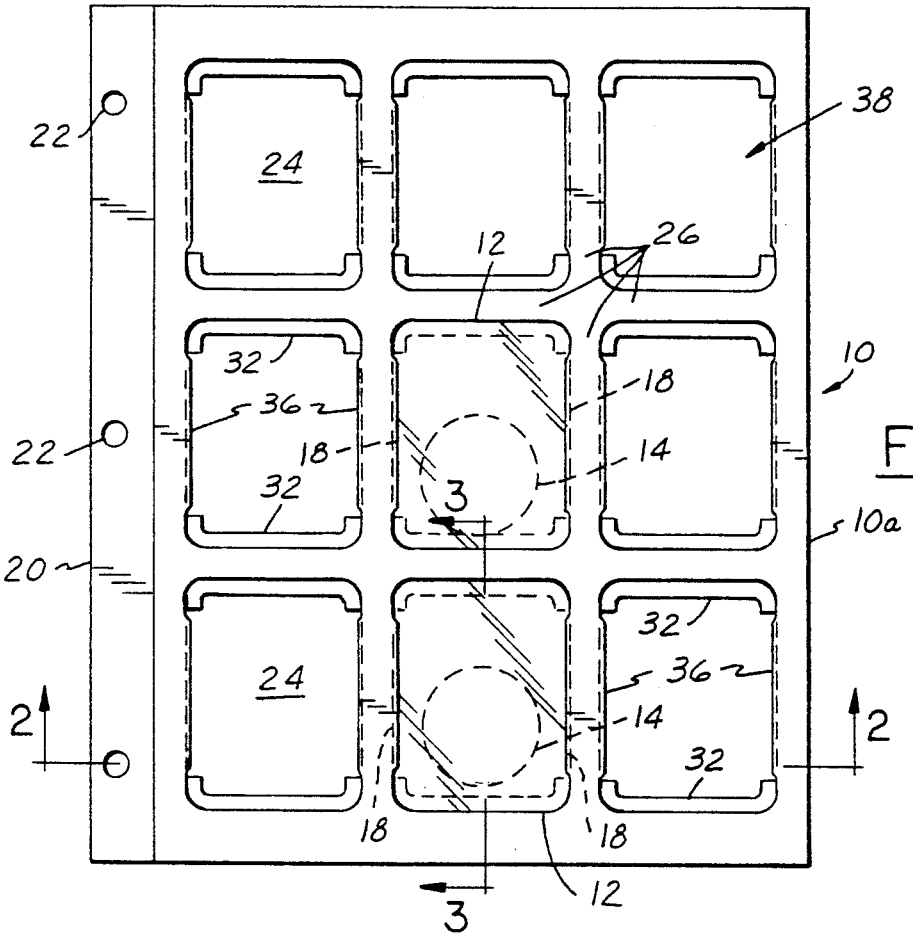
FIG. 1 is a plan view of a first version of the display device according to the present invention, shown in operation.

Referring now to the Drawing, FIG. 1 shows the display device 10 according to the present invention in operation with several slabs 12 (the slabs 12 are certified coin encasements prepared by a certification service such as those cited hereinabove). The display device 10 is generally shaped in the form of an album page, and is structured to receive a plurality of slabs 12 in a regularly spaced pattern.

Each slab 12 is of a rectangular shape, and structured to receive internally a coin 14. Further, each slab 12 is shaped so as to have two opposing sides 16 and a peripheral edge 18. The slab is composed of a light passable plastic material which permits viewing of each side of the coin 14, yet protects the coin from environmental interaction. The slab 12 is intended to serve as a protective housing for the coin and at the same provide the user with visible access to the coin without physical access to it. Consequently, the slab 12 is constructed without structures that allow it to be connected with any other structure.

The display device 10 according to the present invention is structured to receivably retain slabs in a selectively releasable manner without any specific structure of the slab being required for this purpose.

Figure 2:
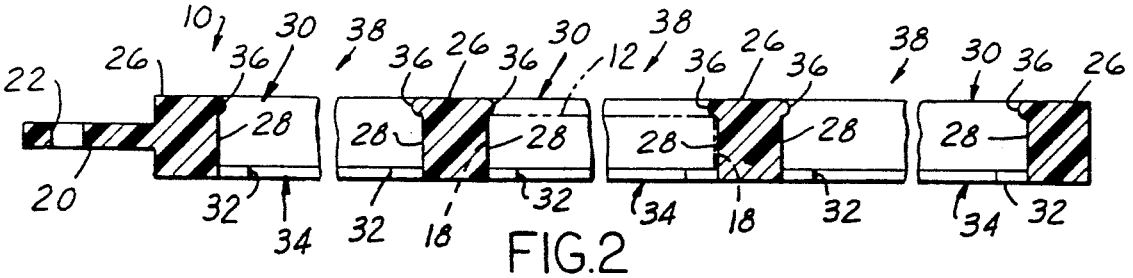
FIG. 2 is a sectional end view of the display device, seen along lines 2—2 in FIG. 1.
Figure 3:
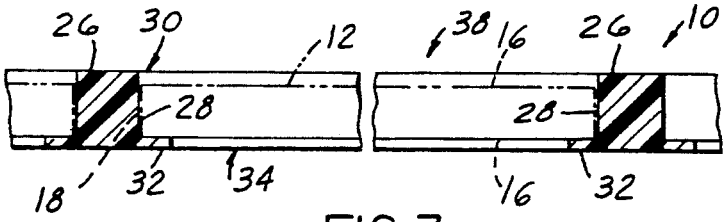
FIG. 3 is a fragmentary sectional side view of the display device, seen along lines 3—3 in FIG. 1.

As can be understood by reference now being made to FIGS. 1 through 3, the display device 10 is composed of a mounting frame **10*a* having a generally rectangular shape, preferably in the construction of an album page. In the preferred construction, album operation is made possible by providing an integral mounting flange 20 having holes 22** for being received by rings of a conventional ringed binder album.

The display device is preferred to be constructed of a plastic material that is at least sufficiently rigid to generally retain its shape when acted on by the forces usually encountered in handling. The display device has a plurality of apertures 24 which are dimensioned to match the dimensions of a slab 12. The apertures are located in a pleasing, functional and efficient arrangement. In this regard, it is preferred to space the apertures closely, yet provide that the material of the display device located between the apertures, in the form of ribs 26, be sufficiently strong to resist bending during normal handling. The apertures 24 are defined by sidewalls 28 which are dimensioned so as to substantially abut with respect to the edges 18 of a slab 12 that has been inserted thereinto.

On one end 34 of the apertures 24 there is located a peripheral lip 32. It is preferred for the peripheral lip 32 to extend completely around the end 34 of the apertures except in those portions of the end 34 in direct axial alignment with the bosses 36, as shown in FIG. 1. While this is not a requirement, it is preferred so as to facilitate plastic injection molding of the display device 10. The peripheral lip 32 extends into the aperture 24 a distance sufficient to serve as an abutment for the slab 12 placed into the aperture, yet not extend so far as to cover-over significantly the side of the slab facing the peripheral lip. Of course, if the display device is constructed of a clear material, then the peripheral lip may be of any extent, even extending completely across the aperture 24. However, it is preferred simply that the peripheral lip be dimensioned as is required to mechanically interfere with the slab inserted within the aperture from exiting out the end 34.

The other end 30 of the apertures 24 is provided with a pair of bosses 36 located on opposing sidewalls thereof. The bosses 36 extend into the aperture 24 and are resiliently yieldable in order to permit a slab 12 to be inserted into the aperture past the bosses. That is, the bosses extend a short distance into the aperture enough to abuttably retain a slab within the aperture, yet not so much so that a slab cannot be slipped therepast. Thusly, the bosses 36 are dimensioned so as to nominally mechanically interfere with the slab seated within the aperture from exiting out the end 30, yet are small enough to pliably yield so as to allow the slab into and out of the aperture at end 30 by hand force of the user. This force is preferred to be an amount which is comfortable for the user and which is much less than a level of force which could damage the display device 10 or cause slabs seated in other apertures from being dislodged as the subject slab is being inserted or removed from its respective aperture.

Accordingly, it will be understood that the combination of each aperture 24, as characterized by sidewalls 28, peripheral lip 32 and bosses 36, form a seat 38 for selectively releasably retaining the slab with respect to the mounting frame 10'.

In operation, the user places a slab above the bossed end of a selected aperture, and then carefully presses the slab past the bosses so as to seat the slab within the aperture. Now the sidewalls, peripheral rim and bosses abuttably retain the slab and yet permit the user unobstructed view of the coin therewithin. Should the user wish to remove the slab from the aperture, the user need only press carefully on the slab so as to force it again past the bosses and out of the aperture.

Figure 4:
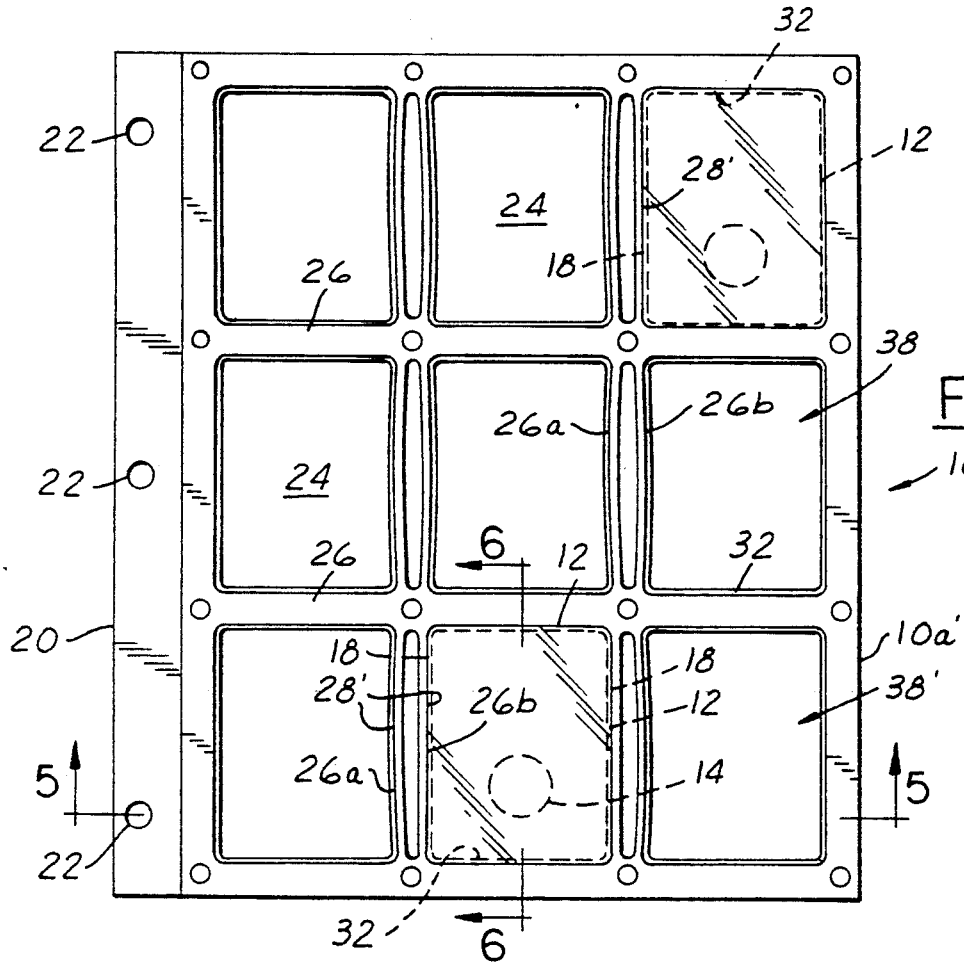
FIG. 4 is a plan view of a second version of the display device according to the present invention, shown in operation.
Figure 5:
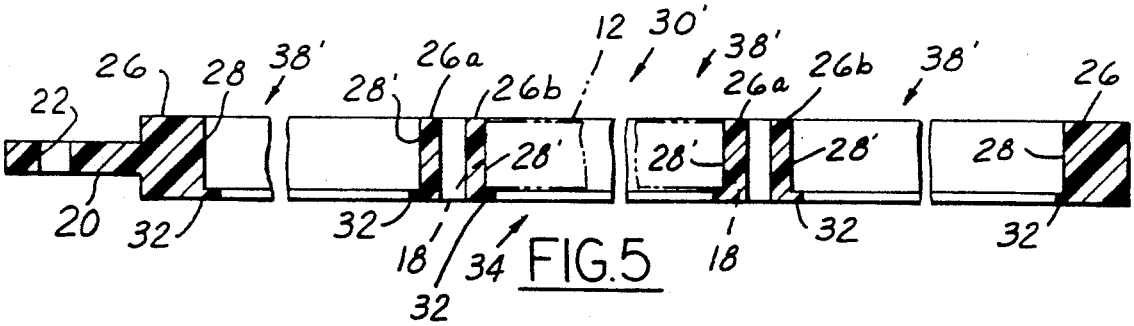
FIG. 5 is a sectional end view of the display device, seen along lines 5—5 in FIG. 4.
Figure 6:
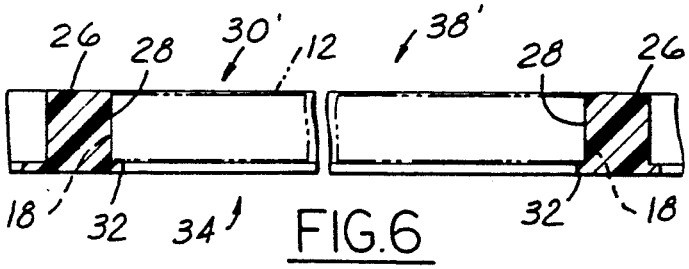
FIG. 6 is a fragmentary sectional side view of the display device, seen along lines 6—6 in FIG. 4.

Referring now to FIGS. 4 through 6, depicted is an alternative display device 10' in which all features are shared with the display device 10 discussed above, except the bosses 36 are not present and at least one of the ribs 26 adjacent a sidewall 28 of each aperture 24 is now subdivided into two rib components **26*a* and 26*b*. Rather than utilizing the bosses to releasably retain the slab 12 in a seated relationship with respect to the aperture, the rib component adjacent the aperture is formed so that the sidewall 28' that it is associated with is resiliently curved biasably into the aperture. Accordingly, it will be understood that the combination of each aperture 24, as characterized by sidewalls 28 and 28', and the peripheral lip 32 form a seat 38' for selectively releasably retaining the slab with respect to the mounting frame 10'**.

In operation, the user places a slab above the open end 30' of a selected aperture, and then carefully presses the slab into the aperture, thereby forcing the sidewalls 28' to pliably move into a straight configuration so as to seat the slab within the aperture. Now the peripheral rim and friction between the sidewalls and the edges of the slab hold the slab and yet permit the user unobstructed view of the coin. Should the user wish to remove the slab from the aperture, the user need only press carefully on the slab so as to force it out of the aperture against the force of friction with respect to the sidewalls.

To those skilled in the art to which this invention appertains, the above described preferred embodiment may be subject to change or modification. For instance, articles other than slabs can be releasably retained in the seats of the display device according to the present invention. Such change or modification can be carried out without departing from the scope of the invention, which is intended to be limited only by the scope of the appended claims.

What is claimed is:

1. A display device for holding at least one article, each article having predetermined dimensions characterized by a first side, a second side and an edge located between said first and second sides, said display device comprising:

a substantially inflexible mounting frame having at least one seat for releasably holding one said article therein, each seat comprising:

seat sidewalls defining an aperture through said mounting frame, said aperture having a first end and a second end, said seat sidewalls being dimensioned to abuttably receive one said article;

peripheral rim means connected with said seat sidewalls at said first end of said aperture for abuttably engaging the article so as to prevent the article from exiting said aperture at said first end thereof; and boss means connected with said seat sidewalls at said second end of said aperture for resiliently yielding when one said article is caused to be inserted into said seat and for releasably retaining the article in said seat;

wherein said boss means and said mounting frame are structured so that said boss means resiliently yields while said mounting frame is substantially unflexed when one said article is caused to be inserted into said seat, and said peripheral rim means is structured to abuttably engage the article to prevent the article from exiting said aperture at said first end thereof when the article is located in said seat; wherein further each of said peripheral rim means, said boss means and said seat sidewalls abut one said article so as to interferingly trap the article within said seat, said boss means being structured to extend a substantial length along at least two opposing said sidewalls of said aperture, said boss means being further structured to resiliently yield upon abutment with respect to the article so that the article is pressed into said seat and is pressed out from said seat by a user using only a comfortable amount of force which is substantially less than that which could damage said mounting frame so as to move the article past said boss means.

2. The display of claim 1, wherein said mounting frame is structured to form an album page for a ringed album binder; said mounting frame further comprising mounting flange means integrally connected with said mounting frame for connecting said mounting frame with the rings of the album binder.

3. The display device of claim 2, wherein said mounting frame has a plurality of seats disposed therewith.

4. The display device of claim 3, wherein said seat sidewalls are structured to mate with an article in the form of a coin certification encasement, referred to popularly as a slab.

5. A display device for holding at least one article in each of three dimensional axes, each article having predetermined dimensions characterized by a first side, a second side and an edge located between said first and second sides, said display device comprising:

a substantially inflexible mounting frame having at least one seat for releasably holding one said article therein, each seat comprising:

seat sidewalls defining an aperture through said mounting frame, said aperture having a first end and a second end, said seat sidewalls being dimensioned to abuttably receive one said article, at least one of said seat sidewalls being curved a predetermined amount so as to resiliently bias into said aperture; and peripheral rim means connected with said seat sidewalls at said first end of said aperture for abuttably engaging the article so as to prevent the article from exiting said aperture at said first end thereof;

wherein the at least one curved seat sidewall is structured to abut one said article and thereupon resiliently yield by the curve thereof becoming less than said predetermined amount when the article is caused to be inserted into said seat, and said peripheral rim means is structured to abuttably engage the article to prevent the article from exiting said aperture at said first end thereof when the article is located in said seat; wherein further each of said peripheral rim means and said seat sidewalls abut one said article so as to interferingly trap the article within said seat in combination along two dimensional axes, and friction between the edges of the article and said seat sidewalls retains the article within the seat along the third dimensional axis.

6. The display device of claim 5, wherein said mounting frame is structured to form an album page for a ringed album binder; said mounting frame further comprising mounting flange means integrally connected with said mounting frame for connecting said mounting frame with the rings of the album binder.

7. The display device of claim 6, wherein said mounting frame has a plurality of seats disposed therewith.

8. The display device of claim 7, wherein said seat sidewalls are structured to mate with an article in the form of a coin certification encasement, referred to popularly as a slab.

* * * * *